United States Patent [19]

Caustic

[11] Patent Number: 5,060,409

[45] Date of Patent: Oct. 29, 1991

[54] STEADY HOLD-SHOOTERS REST

[76] Inventor: Dennison M. Caustic, 2305 Jungle St., Lakeland, Fla. 33801

[21] Appl. No.: 623,126

[22] Filed: Dec. 3, 1990

[51] Int. Cl.[5] ..... F41A 23/00

[52] U.S. Cl. ..... 42/94

[58] Field of Search ..... 42/94; 89/37.04

[56] References Cited

U.S. PATENT DOCUMENTS

| | | | |
|---|---|---|---|
| 46,365 | 2/1865 | Kinman | 42/94 |
| 759,593 | 5/1904 | Cover | 42/94 |
| 941,640 | 11/1909 | Lawson | 42/94 |
| 3,200,528 | 8/1965 | Christensen | 42/94 |
| 3,390,477 | 7/1968 | Galbraith | 42/94 |
| 4,515,301 | 5/1985 | A'Costa | 42/94 |

*Primary Examiner*—Charles T. Jordan

[57] ABSTRACT

The steady hold-shooters rest is an improved rest designed to provide a shooter with a steady hold on a target by incorporating the individuals total body strength and weight into maintaining a steady hold while moving the aiming point in a smooth, continuously supported manner as required by the situation encountered while hunting or shooting. This steady hold feature is accomplished by the use of an elliptical arm rest bar attached solidly to a body support bracket which is in turn fastened around the waist of the shooter and positioned directly in front of him/her so that the arm rest bar extends by the shooters sides at close proximity while extending at greater distance from the shooters body as it approaches the center point of the rest. The shooter has steady hold when his/her arm supporting the weapon at the force end is placed in contact with the arm rest bar so that the bar strikes this arm just above the elbow.

3 Claims, 3 Drawing Sheets

STEADY HOLD-SHOOTERS REST

TECHNICAL FIELD OF THE INVENTION

This invention pertains to the category of firearms accessories, more particularly to rests.

DESCRIPTION OF THE PRIOR ART

Many devices have been invented to overcome the problem of how to steady a shoulder held weapon while aiming and firing. Some devices are attached to the weapon, others use portable hand held devices, still others use devices attached to railings posts, or benches. All of these devices require adjustment of the device to meet the target acquisition need of the shooter. They must be adjusted for each shooting situation and have limited flexibility for adjustment to moving targets as encountered in the hunting situation.

SUMMARY OF THE INVENTION

The Steady Hold-Shooters Rest is worn around and in front of the waist of the shooter, thereby moving with the shooter as an appendage. It requires no adjustment and therefore provides rapid aiming at moving targets and allows instant following of the target, while giving a shooter a steady hold even if the weapon is held in firing position for several minutes. The device is designed to automatically compensate for changes in the distance of a shooters support arm from his body as he/she changes from a side shooting stance to a frontal shooting stance or vice-versa. A shooter wearing this device can shoot from any position except the prone position. The device can be used by shooters who shoot either left or right handed, left handed only, or right handed only. This device is extremely versatile for firing any shoulder type weapon, including crossbows in almost all shooting situations requiring rapid target acquisition and steady hold.

DESCRIPTION OF PREFERRED EMBODIMENTS

Figure 1:
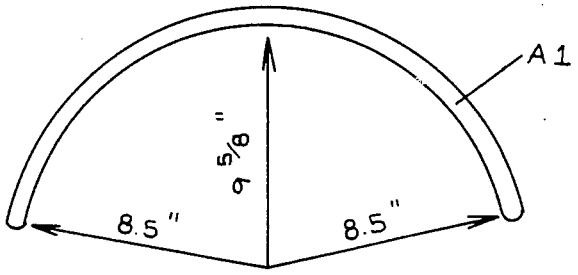
FIG. 1. Basic bar (A) which forms the body support bracket (two bars are required) the bending radius is also depicted.
Figure 2:
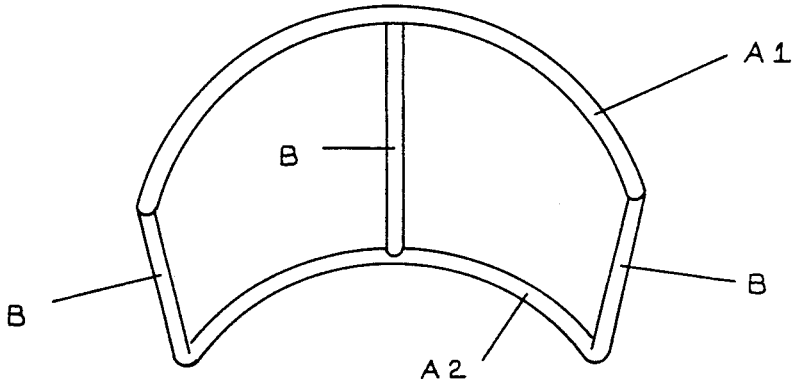
FIG. 2. Assembled body support bracket with spacers. Showing (A1) as the top bar and (A2) as the bottom bar. Spacers are labeled (B).
Figure 4:
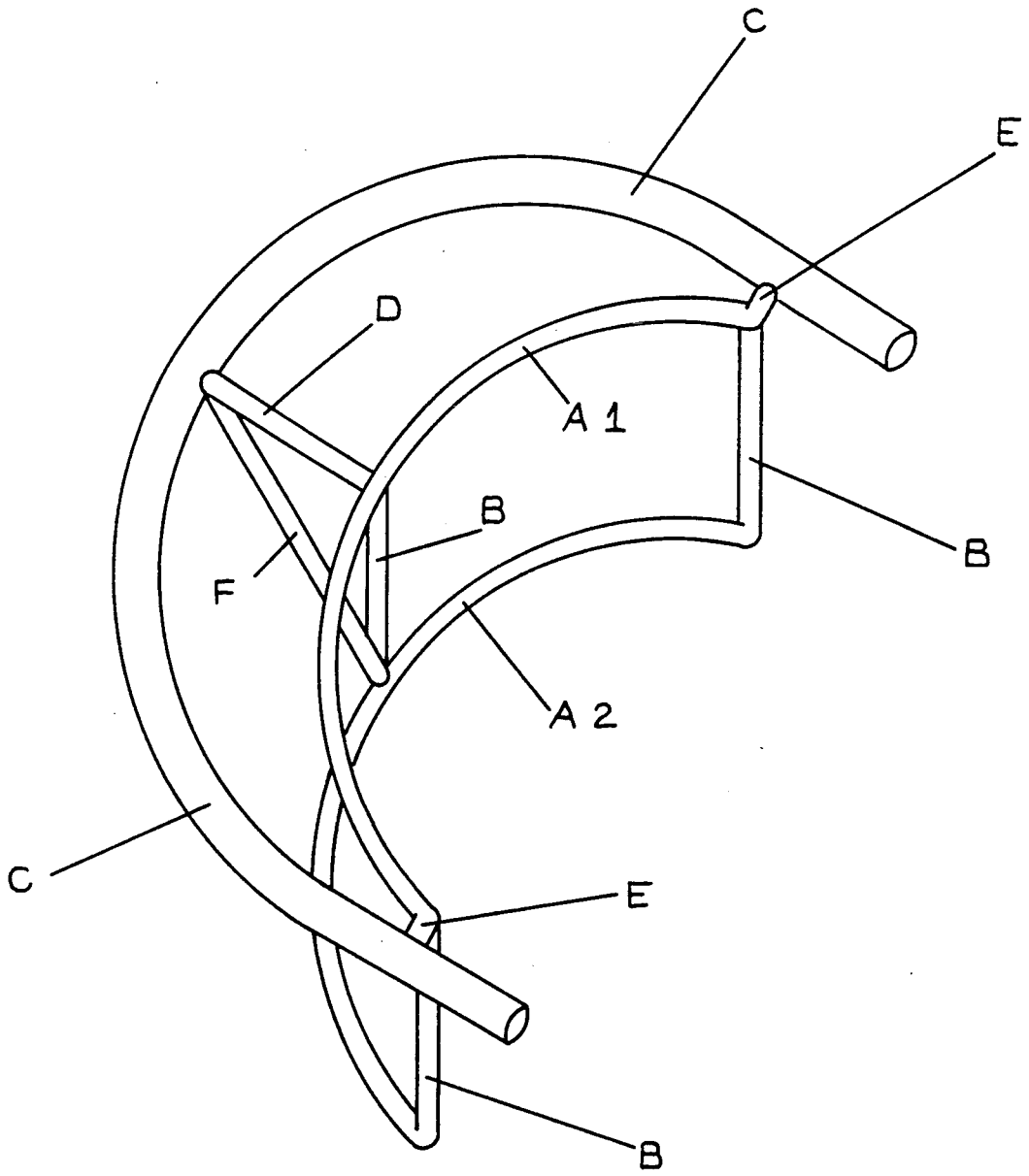
FIG. 4. Perspective view of steady hold-shooters rest. (waist belt is not a part of this patent application and therefor is not shown).

Referring to the drawings, wherein like reference characters designate like or corresponding parts throughout the several views, there is shown in FIG. 1. The basic bars (A), of which there are two, (A1) and (A2). They are made from ½ in. stock, are 18 in. long and are bent to radius as depicted in FIG. 1. Together with three 6 in. spacers, (B) one in the center and one on each end, these basic bars (A1)/(A2) form the body support bracket depicted in FIG. 2. While the body support bracket FIG. 2 is held in a vertical position, as it would be positioned on a shooters waist, a 1 in. diam.×36 in. long bar is bent elliptically to form the arm rest bar (C) and is attached to the top bar (A1) by three spacers. A ½ in. diam.×4 in. long spacer (D) is centered between top bar (A1) of the body support bracket and the arm rest bar (C) and two ½ in. diam.×½ in. long spacers (E) are fastened at each end of body support bracket to bar (A1) and to the arm rest bar (C) at the point where the natural bend of the arm rest bar (C) hits the spacers (E). The arm rest bar (C) extends past the end of the body support bracket top bar (A1) an equal distance on each side to insure that the shooters support arm will remain on the arm rest bar (C) at all times. In FIG. 1 a ½ in. diam.×7½ in. long gusset bar (F) is tapered at both ends to fit the junction with bars (A2) and (C) and is fastened between the center of the arm rest bar (C) and the center of the bottom bar (A2) of the body support bracket as depicted in FIG. 4. The purpose for bar (F) is to maintain the arm rest bar (C) perpendicular to the plane of the body support bracket at all time.

Figure 3:
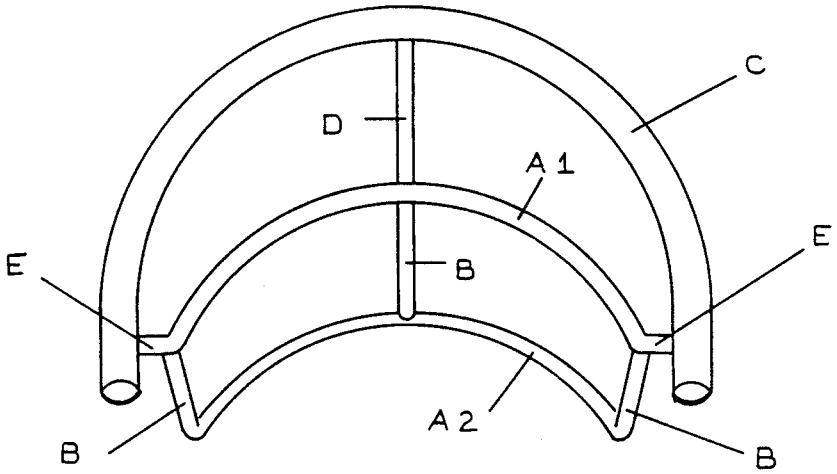
FIG. 3. Vertical dimension showing relationship of the arm rest bar (C) to the body support bracket.
Figure 5:
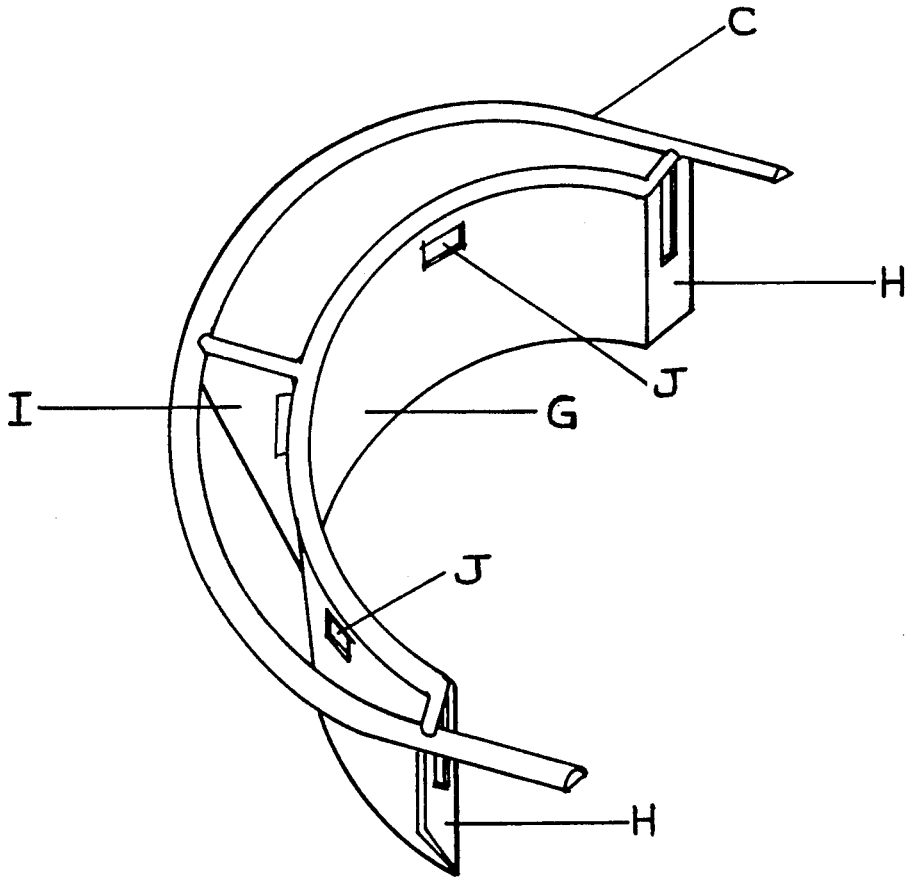
FIG. 5. Perspective view of injection molded plastic version of steady hold-shooters rest.

FIG. 5. The body support bracket (G) is molded solid and replaces bars (A1)(A2) and (B) (FIG. 2). The front supporting gusset labeled (I) is also molded solid except for a belt slot (¼"×2¼"). This gusset (I) replaces (D) and (F) shown in FIG. 4. (E) shown in FIG. 4 is replaced on both sides by a molded gusset w/ belt slot (¼"×2¼"). Both gussets are labeled (H). The arm rest bar (C) is molded in the same process with the body support bracket (G) and gussets (H), and is molded as a half-round instead of a solid bar. The arm rest bar (C) is spaced the same distance from the body support bracket (G) as depicted in FIG. 3 and FIG. 4. Two shoulder strap attachment slots (½"×1¼") are placed in the body support bracket (G) and are labeled (J). This will be the manufactured model.

What is desired to be secured by Letters Patent of the United States:

1. A shooting rest comprising: a body support bracket having top and bottom bars bent on a radius and held together by three spacer bars placed one on each end and one in the center of said top and bottom bars; an arm rest bar bent elliptically and fastened to the top bar of said body support bracket by a spacer bar at the center of the arm rest bar and a shorter spacer bar at each end of the body support bracket; said arm rest bar being further secured to said body support bracket by a gusset bar between the center of the arm rest bar and the center of the bottom bar of said body support bracket; and said shooting rest having a belt for securing the body support bracket to a shooter's waist, and neck or shoulder straps for positioning the rest higher or lower on the shooter's waist.

2. A shooting rest as claimed in claim 1 wherein said rest is sized proportionately to fit various sized shooters.

3. A shooting rest as claimed in claim 1 wherein said rest is molded of plastic.

* * * * *